US005879153A

United States Patent [19]

Slejertin

[11] Patent Number: 5,879,153

[45] Date of Patent: Mar. 9, 1999

[54] CANDLE SCULPTURE FOR EXPOSING A NON-FLAMMABLE OBJECT

[75] Inventor: Brigitte Slejertin, Huntington, N.Y.

[73] Assignee: Easter Unlimited, Inc., Carle Place, N.Y.

[21] Appl. No.: 744,097

[22] Filed: Nov. 5, 1996

[51] Int. Cl.[6] ..... F23D 3/16

[52] U.S. Cl. ..... 431/295; 431/289; 431/292; 431/125; 431/126; 362/161; 362/DIG. 808

[58] Field of Search ..... 431/125, 288, 431/289, 291, 292, 126, 253; 362/161, DIG. 808; D26/6, 7, 16, 17, 18

[56] References Cited

U.S. PATENT DOCUMENTS

| | | | |
|---|---|---|---|
| 1,551,104 | 8/1925 | Hawley | 431/288 |
| 1,709,889 | 4/1929 | Tasker | 431/288 |
| 1,831,902 | 11/1931 | Brown | 431/288 |
| 2,354,343 | 7/1944 | Webber et al. | 431/288 |
| 2,841,972 | 7/1958 | Weglin | 431/288 |
| 2,959,950 | 11/1960 | Weglin | 431/126 |
| 3,462,235 | 8/1969 | Summers | 431/289 |
| 3,917,441 | 11/1975 | Gray | 431/288 |
| 4,225,552 | 9/1980 | Chang | 431/288 |
| 4,682,947 | 7/1987 | Luken, Jr. et al. | 431/288 |
| 4,696,640 | 9/1987 | Pitchford | 431/289 |

*Primary Examiner*—Carl D. Price
*Attorney, Agent, or Firm*—Lackenbach Siegel Marzullo Aronson & Greenspan, P.C.

[57] ABSTRACT

A novelty candle includes an exterior meltable body made of wax which has a first predetermined configuration, such as a human hand, and in interior body formed of a generally non-meltable material, such as a stone-like material, is embedded within the hand. The interior body, in the form of skeletal components of a human hand is smaller than but otherwise substantially corresponds to the shape of the hand. One or more wicks are used to gradually burn and/or melt away the outer wax shell or layer to gradually expose the skeletal components. A surface coloration coating may be used on the wax shell to simulate the skin of a hand, and the wax may be given a color, such as red, to simulate blood when the outer shell melts and drips on the portion of the hand that remains. A candle is also described in the form of a coffin made of wax which gradually exposes a skeleton when the wicks of the candle are lit and the coffin melts away.

14 Claims, 2 Drawing Sheets

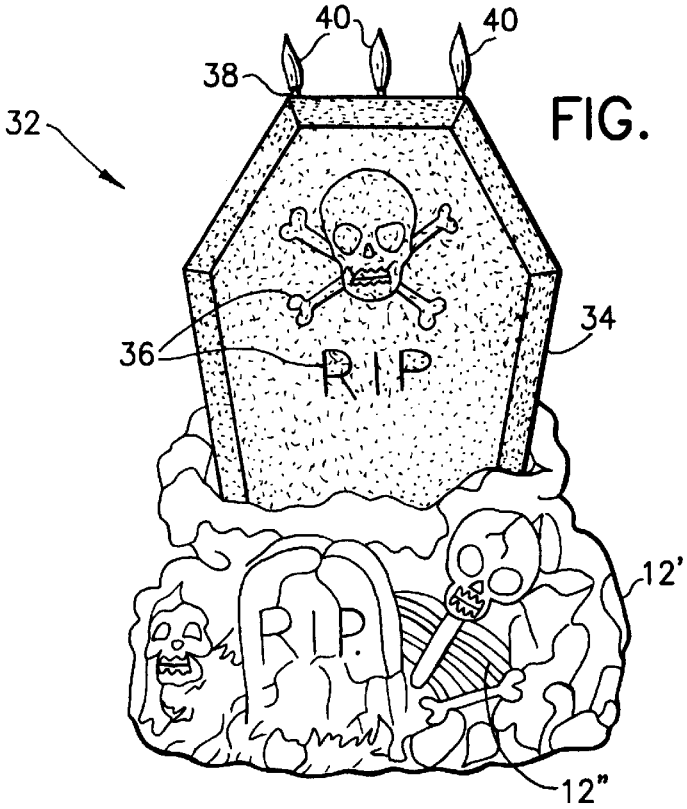
FIG. 4
FIG. 5
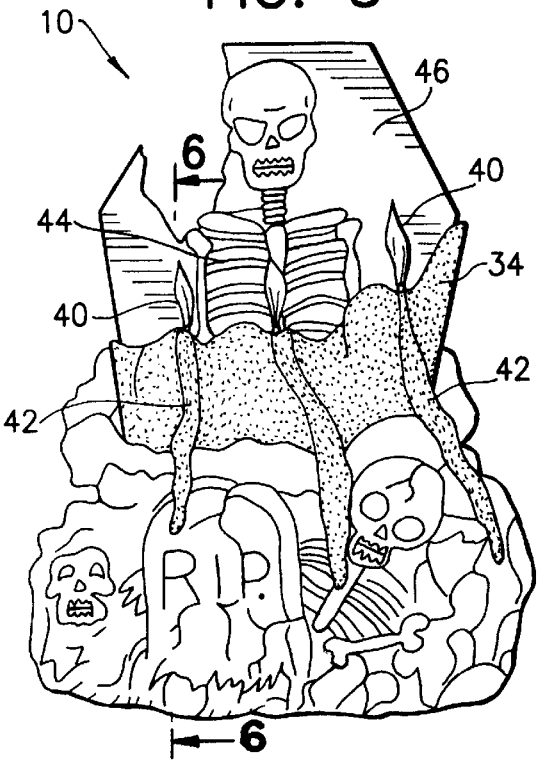
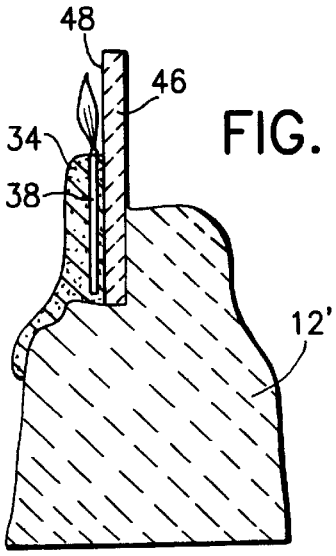
FIG. 6

CANDLE SCULPTURE FOR EXPOSING A NON-FLAMMABLE OBJECT

BACKGROUND OF THE INVENTION

1. Field of the Invention

This invention generally relates to candle-related novelties and, more specifically, to candle sculptures of objects with initially concealed related objects.

2. Description of the Prior Art

A number of patents disclose a free-standing form which reveals a concealed item within a candle, which can only be viewed after the candle has been consumed. For example, U.S. Pat. No. 4,682,947 issued to Luken Jr., et al. discloses a candle, which, upon burning, forms a decorative, aesthetically pleasing free-standing shell having a filigree or lace-like pattern. This decorative candle is formed by processing the candle in accordance with the patent, including carefully selecting the dimensions of the wick, candle diameter, etc. The candle does not have a solid or non-flammable or non-meltable structure concealed within the wax which becomes exposed upon the burning of the wax. The candle disclosed consists of a fatty acid fuel composition, predominantly stearic acid and palmitic acid. To obtain the desired decorative effect, the ratio of the wick size of the candle diameter is maintained at 12 or 19 plies per inch.

U.S. Pat. No. 4,696,640 issued to Pitchford discloses a fortune candle which contains a fire-proof, leak-proof container which houses a personalize message therein. The message may be a fortune, words of endearment, or a game token and/or a coupon redeemable for a prize. The prize container is initially hidden from the viewer. The candle is consumed until such time as the container or token is revealed. Alternatively, the candle can have a strip extending along the longitudinal axis of the candle which is gradually exposed as the candle burns. Additional portions of the message of the strip become readable as the candle burns. This patent discloses, therefore, either an embedded container or a flat strip which bears writing. However, the candle is a standard upright candle having a generally uniform circular cross section and the configuration of the candle has no bearing or relationship whatsoever to the shape or configuration of the embedded container or the strip on which writing has been provided.

In U.S. Pat. No. 3,428,409 issued to Summers, a rigid core-wick is disclosed. However, the core is primarily provided for insuring dripless burning and for preventing the candle from bending in high ambient heat. The rigid core is also intended to prevent sagging of the candle during burning. However, the core itself is typically made of a higher melting material which, however, is ultimately likewise consumed and does not otherwise affect the burning characteristics of the candle. Once the candle has been consumed, the internal rigid core like in the patent to Pitchford, bears no physical configurational relationship with the external shape of the candle. In the disclosed patent, both the rigid core as well as the external candle configuration are both cylindrical and have no other functional or esthetic relationship.

SUMMARY OF THE INVENTION

Accordingly, it is an object of the present invention to provide a novelty candle which is different from known candle novelty items and provides new and different results or effects.

It is another object of the present invention to provide a candle-related novelty item which is simple in construction and economical to manufacture.

It is still another object of the present invention to provide a novelty candle as suggested in which the external configuration of the candle and the configuration of the internal object embedded within the candle are both three-dimensional sculptures wherein the external sculpture is meltable while the internal sculpture is not.

It is yet another object of the present invention to provide a novelty candle as suggested in the previous objects, in which the external candle configuration and the internal concealed object configuration are related objects which are normally associated with and found one within the other.

It is a further object of the present invention to provide a candle-related novelty item in which the shape of the external candle generally conforms to the shape of the interior sculpture or object and forms a substantially uniform thickness shell about the interior concealed body.

In order to achieve the above objects, as well as others which will become apparent hereinafter, a novelty device in accordance with the present invention comprises an exterior meltable body having a first predetermined configuration. An interior body formed of a generally non-meltable material is provided and embedded within said exterior body. Said interior body has a second pre-determined configuration which is smaller than but otherwise substantially corresponds to said first predetermined configuration. Melting means is provided for selectively melting said exterior body. In this manner, said interior body forms a shell about and initially conceals said interior body, and melting of said exterior body gradually exposes said interior body.

In accordance with a presently preferred embodiment, the exterior body is formed of wax and the melting means is in the form of a wick which extends through the wax to form a candle. While the exterior body is non-meltable, it is preferably substantially non-flammable and formed of a stone like material or a non-meltable plastic material.

While the novelty candle may find numerous applications, it is particularly suitable for use in connection with various holiday themes and, in particular, Halloween. When used in connection with the aforementioned holiday theme, the exterior body may be configurated in the shape of a hand while the configuration of the interior body is in the shape of skeletal components of a hand. Another example is an exterior body or candle in the shape of a coffin, with the interior body has the shape of a skeleton which becomes gradually exposed as the coffin candle is consumed.

The present invention also contemplates an arrangement wherein said interior body has a second predetermined configuration which is normally related to and normally disposed within said first configuration.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which:

FIG. 4 is a front elevational view of another embodiment in accordance with the present invention, in which the candle is in the form of a coffin, shown with three wicks lit, but prior to melting of the candle;

FIG. 5 is similar to FIG. 4, shown in a partially molten state of the exterior wax body or candle to expose an interior body in the form of a human skeleton; and FIG. 6 is a cross sectional view of the embodiment shown in FIG. 5, taken along line 6—6.

DESCRIPTION OF THE PREFERRED EMBODIMENTS

Figure 1:
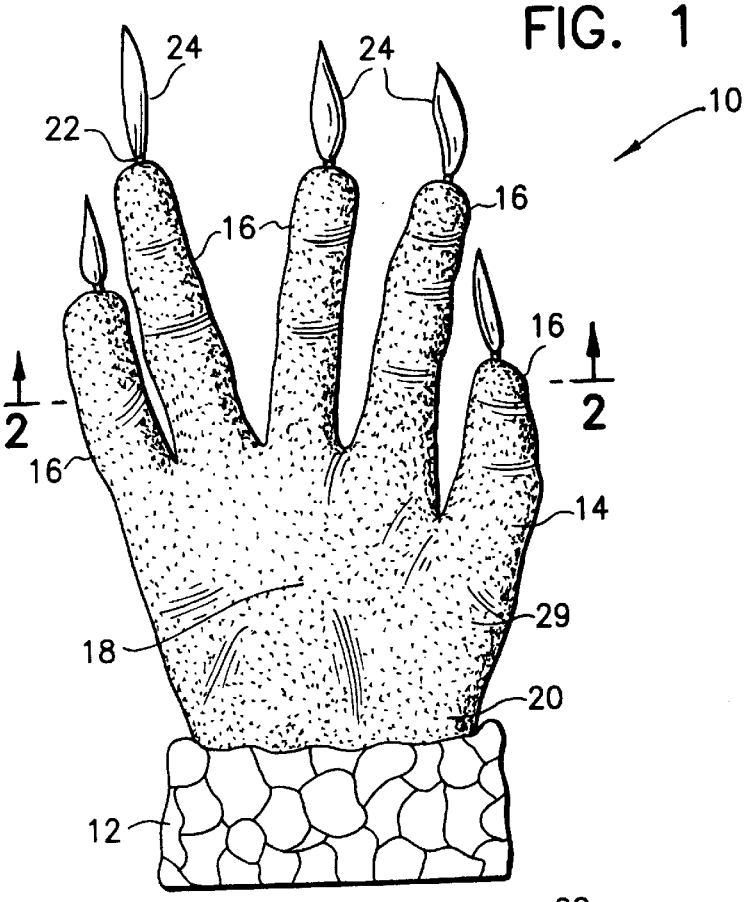
FIG. 1 is a front elevational view of a novelty candle in accordance with the present invention, in which the candle is in a form to simulate a normal hand, showing five wicks, one associated with each of the fingers of the hand, when the wicks are first lit and prior to melting of the candle.

Referring now specifically to the Figures, in which similar or identical parts are designated by the same reference numerals throughout, and first referring to FIG. 1, a novelty candle in accordance with the presently invention is generally designated by the reference numeral 10.

Although the presently preferred embodiments of the invention are in the form of candles, it will become clear that the invention can be practiced in other forms, as will be suggested hereinafter.

Advantageously, the candle 10 is mounted on a base 12 which is made of a non-meltable and, preferably, a non-flammable material. The base may be made of a stone-like material or a non-flammable plastic. However, any satiable material may be used for the base, as long as it provides a good foundation for the candle 10 and is resistant to an exposed flame.

The base 12 supports an exterior body 14, which is formed of a meltable material. In the presently preferred embodiment, the exterior body 14 is made of a wax commonly used for making candles, the exterior body 14 melting when exposed to a flame and ultimately becoming consumed, much in the same way as a normal candle melts and is consumed. In the embodiment illustrated in FIG. 1, the exterior body 14 is in the shape of an upwardly extending human hand having fingers 16, a palm 18 and a wrist 20 supported by the base 12.

Means are provided for selectively melting the exterior body 14. In the illustrated embodiment, five wicks 22 are embedded within the exterior body 14, the wicks extending along the fingers 16, through the palm 18 and preferably down to the wrist 20. The extent to which the wicks 22 extend below the fingers is not critical and the wicks may extend downwardly below the fingers to any desired extent. As will become evident, however, the further that the wicks extend below the fingers, the more of the material forming the exterior body 14 that can be melted. By igniting the wicks 22, the flames 24 serve to melt the exterior body 14, made of wax in the embodiment being described, to cause drops of wax or streams of wax 26 to flow down the fingers 16, palm 18 and the wrist 20, excess wax being accumulated and forming on the base 12 as best shown in FIG. 3.

Figure 3:
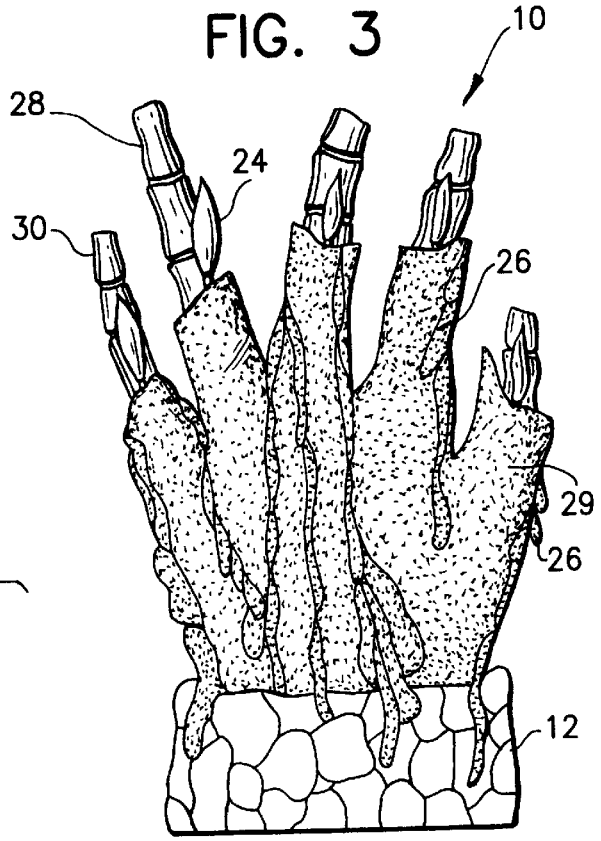
FIG. 3 is a front elevational view of the candle as shown in FIG. 1, after the burning wicks have caused initial melting of the wax shell forming the candle to expose the interior non-meltable body which is in the form of skeletal components of the fingers of the hand.
Figure 2:
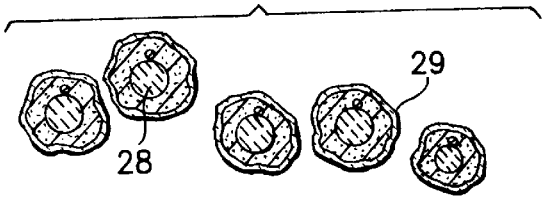
FIG. 2 is a cross sectional view of the novelty device shown in FIG. 1, taken along line 2—2.

Referring to FIGS. 2 and 3, the novelty candle 10 also includes an interior body 28 formed of a generally non-meltable material and embedded within the exterior body 14. The interior body has a second predetermined configuration which is smaller than but otherwise substantially corresponds to the first predetermined configuration of the exterior body 14. In this manner, the exterior body 14 forms a shell about and initially conceals the interior body 28. Melting of the exterior body, as suggested in FIG. 3, gradually exposes the interior body 28. Where the exterior body is in the form of a hand, shown in FIG. 1, the configuration of the interior body 28 is in the shape of skeletal components of the hand, the phalanges of the human skeletal components of the hand 30 being shown in FIG. 3. As the wax forming the exterior body 14 continues to melt, more and more of the interior body 28 is exposed, the metacarpal bones being exposed when the exterior body melts in the region of the palm 18 and the carpal bones when the exterior body 14 melts in the region of the wrist 20.

While a candle 10 is in the form of a human hand has been illustrated, it will also be clear that the exterior body 14 can assume a configuration in the shape of any portion of the human body, in which case the interior body is in the shape of the skeletal components normally found below the external surface of that portion of the human body. In fact, the candle 10 need not be only in the form of a human body but can assume any desired configuration, be it of a natural or a supernatural being.

In accordance with an advantageous feature of the invention, the exterior body 14 is preferably covered with a flammable coating 29 which simulates the appearance of skin or outer covering of the human hand, or any other exterior surface of the object being represented, the exterior body 14 being formed of a red wax, so that during burning of the coating 29 and melting of the wax 14 simulates the flow of blood as the melting wax 26 streams down the exterior body 14. While the interior body 28 should be non-meltable, so that it does not melt and flow as does the wax forming the exterior body when exposed to the flame 24, the interior body is preferably also non-flammable so that it totally resists the flame 24. However, as long as the interior body 28 does not melt and flow as does the wax 14, it may be slightly flammable to become charred. In this respect, the interior body may be formed of a stone-like material or a non-meltable plastic material.

In the presently preferred embodiment, the interior body 28 is a three-dimensional object, such as the skeletal components of a human hand, the exterior body forming a shell of substantial uniform thickness about the interior body 28.

In accordance with another feature of the invention, the interior body 28 has a predetermined configuration which is normally related to and normally disposed within a configuration associated with the exterior body. Therefore, where the exterior body 14 is configurated in the shape of a human hand, the configuration of the inner body 28 is in the shape of the skeletal components of a hand, which are normally disposed within the hand. Of course, if the exterior body were to be a human head, the interior body would, in that event, be the skull of the human head which is normally disposed within the head.

Referring to FIG. 4, where the novelty candle 32 includes an external body 34 in the configuration of a coffin, the shape of the interior body could be in the form of a skeleton (as to be more fully described in connection with FIG. 5) which is normally related to and normally disposed within a coffin. As should be clear, there is no limit as to the number of combinations of exterior and interior bodies 14, 28 that can be formed that are related to each other and wherein the inner body is normally disposed within the configuration of the exterior body. While the themes that are illustrated in the figures are primarily associated with Halloween, it will also be clear that the invention need not be limited to that theme and may be used in connection with any seasonal or other theme.

Referring to FIG. 4, the exterior body 34 is formed of a meltable material, such as wax, to form a candle. In FIG. 4, the exterior body 34 is in the shape of a coffin which may include optional surface markings 36 which are consistent with the theme or motif of the candle. One or a plurality of wicks 28 are provided, each of which can be set with a flame 40, the number of wicks and positions thereof not being critical and being arranged to provide a desired pattern of melting of the exterior wax body or shell. The base 12', which supports the exterior body 34, may also be provided with textured or sculptured ornamentations also consistent with the theme or motif of the candle. In FIGS. 4 and 5, such surface ornamentation 12" may include, only by way of example, skeletons, gravestones, skulls, and the like.

Burning of the flames 40 causes the exterior body 34 to melt, as does a normal candle, resulting in streams of wax 42 dripping down the candle and unto the base 12' once the wax shell or exterior body 34 has melted sufficiently to uncover originally concealed skeleton 44 and optional coffin back plate 46. As with the novelty candle 10, the coffin 34 may be provided with a colored coating or other ornamental finishing surface layer to simulate the appearance of a coffin. The wax forming the exterior body 34 being made from a different, contrasting color, to provide a desired effect.

While it is contemplated that the skeleton 44 is a three dimensional object which is disposed or arranged in front of the coffin back plate 46, and can optionally provide a measure of support for the skeleton 44, it is also possible to provide suitable indicia on the front surface 48 of the back plate 46 which simulates or gives the appearance of a skeleton. However, a three dimensional skeleton is preferable as it provides a more realistic representation of a skeleton.

Numerous alterations of the above structures herein discussed will suggest themselves to those skilled in the prior art, however, it is to be understand that the present disclosure relates to preferred embodiments of the invention which are for purposes of illustration only and are not to be construed as limitation of the invention. Thus, for example, it is also possible to form the interior bodies, the skeleton of a hand in FIGS. 1–3, and the body skeleton in FIGS. 4–6, so that the various segments of the skeleton are loosely connected and as the wax melts away and ceases to provide adequate support for the skeletal components, these components can separate from the rest of the skeletal arrangements forming the internal bodies and become detached and drop unto the supporting bases or in close proximity thereto. Also, as should be clear, the specific materials from which the inner and outer bodies are made is not critical, as long as the exterior bodies initially cover the interior bodies and conceal the same and ultimately the exterior bodies are gradually removed by burning or melting to expose the interior bodies. While wax is a presently preferred material for the exterior bodies, it should be clear that any suitable material may be used which can melt or burn away, as long as such material is safe and preferably produces little or no harmful fumes.

I claim:

1. Novelty candle comprising a stable base having an upper surface suitable for receiving molten wax and a flat lower surface suitable for placement on a flat surface for supporting the candle; a substantially solid interior body supported on said base and formed of a generally non-meltable material and having a first configuration and predetermined height and width dimensions; and a substantially uniform thickness coating formed of meltable material applied over said interior body and having an external second configuration, the thickness of said coating being substantially less than said height and widthe dimensions; and at least one wick extending through said exterior meltable body, proximate to said interior body, whereby said coating forms a shell about and initially fully conceals said interior body and melting of said exterior body by burning of said at least one wick, gradually and progressively exposes, during consumption of the candle, said interior body which is, sizewise, on the same order of magnitude as the initial candle represented by said second configuration.

2. Novelty device as defined in claim 1, wherein said exterior body is formed of wax.

3. Novelty device as defined in claim 1, further comprising a non-flammable base for supporting said bodies.

4. Novelty device as defined in claim 1, wherein said first predetermined configuration is in the shape of a portion of a human body and said second predetermined configuration is in the shape of skeletal components normally found below the external surface of said portion of the human body.

5. Novelty device as defined in claim 4, further comprising a flammable coating on the exterior surface of said exterior body which simulates the appearance of skin, said exterior body being formed of a red wax, whereby burning of said coating and melting of said wax simulate the flow of blood as the melting wax streams down said exterior body.

6. Novelty device as defined in claim 1, wherein said interior body is non-flammable.

7. Novelty device as defined in claim 1, wherein said interior body is formed of a stone-like material.

8. Novelty device as defined in claim 1, wherein said interior body is formed of a non-meltable plastic material.

9. Novelty device as defined in claim 1, wherein said interior body is a three-dimensional object.

10. Novelty device as defined in claim 1, wherein said first predetermined configuration is in the shape of a hand and said second predetermined configuration is in the shape of skeletal components of a hand.

11. Novelty candle comprising a non-flammable base; an exterior meltable body, having a first predetermined configuration; an interior body formed of a generally non-meltable material and embedded within said exterior body, said interior body having a second predetermined configuration which is smaller than but otherwise substantially corresponds to said first predetermined configuration and having at least two generally upwardly extending portions, joined in the region of said base, and wick means extending through said exterior meltable body proximate to said at least two upwardly extending portions of the said interior body for melting said meltable exterior body when lit, whereby said exterior body forms a shell about and initially fully conceals said at least two generally upwardly extending portions of said interior body and melting of said exterior body gradually exposes said at least two generally upwardly extending portions of said interior body.

12. Novelty device as defined in claim 11, wherein said first predetermined configuration is in the shape of a hand and said second predetermined configuration is in the shape of skeletal components of a hand.

13. Novelty device as defined in claim 12, further comprising five wicks each of which extends through the wax associated with one of the fingers of said hand, whereby the wax forming each of said fingers can be simultaneously lit to thereby substantially simultaneously expose the skeletal bones of each of said fingers.

14. Novelty device as defined in claim 11, wherein said exterior body comprises a shell of substantially uniform thickness about said interior body.

* * * * *